US006622529B1

(12) United States Patent
Crane

(10) Patent No.: US 6,622,529 B1
(45) Date of Patent: Sep. 23, 2003

(54) APPARATUS FOR HEATING CLOTHES

(76) Inventor: Nicholas J. Crane, 30865 Champagne Ct., West Lake Village, CA (US) 91362

( * ) Notice: Subject to any disclaimer, the term of this patent is extended or adjusted under 35 U.S.C. 154(b) by 0 days.

(21) Appl. No.: 10/122,359

(22) Filed: Apr. 15, 2002

(51) Int. Cl.[7] ..... D06B 1/02

(52) U.S. Cl. ..... 68/5 C; 68/58; 8/149.2; 8/149.3

(58) Field of Search ..... 8/149.1, 149.2, 8/149.3; 68/5 R, 6, 5 C, 5 E; 223/70, 235, 222

(56) References Cited

U.S. PATENT DOCUMENTS 2,499,064 A * 2/1950 Hartley
2,703,973 A * 3/1955 Fawcett
2,823,533 A * 2/1958 Klein
3,042,274 A * 7/1962 Freeman
3,049,903 A * 8/1962 Sussman
3,102,796 A * 9/1963 Erickson
3,257,739 A * 6/1966 Wentz
3,601,292 A * 8/1971 Bliss
3,664,159 A * 5/1972 Mazza
3,670,425 A * 6/1972 Benjamin et al.
3,707,855 A * 1/1973 Buckley
3,739,496 A * 6/1973 Buckley et al.
3,805,561 A * 4/1974 Bullock
3,849,815 A * 11/1974 Frauendorf
3,861,179 A * 1/1975 Orchard
4,070,876 A * 1/1978 Thompson et al.
5,036,560 A * 8/1991 Inghirami
5,305,484 A * 4/1994 Fitzpatrick et al.
5,528,912 A * 6/1996 Weber
5,561,880 A * 10/1996 Allen et al.
5,642,572 A * 7/1997 Manning
5,730,006 A * 3/1998 Conley
5,815,961 A * 10/1998 Estes et al.
6,189,346 B1 * 2/2001 Chen et al.
6,311,526 B1 * 11/2001 Frushtick

* cited by examiner

*Primary Examiner*—Frankie L. Stinson

(57) ABSTRACT

A personal dry cleaning apparatus having housing, a wetting means, and sources of heat to form steam to be generated.

11 Claims, 5 Drawing Sheets

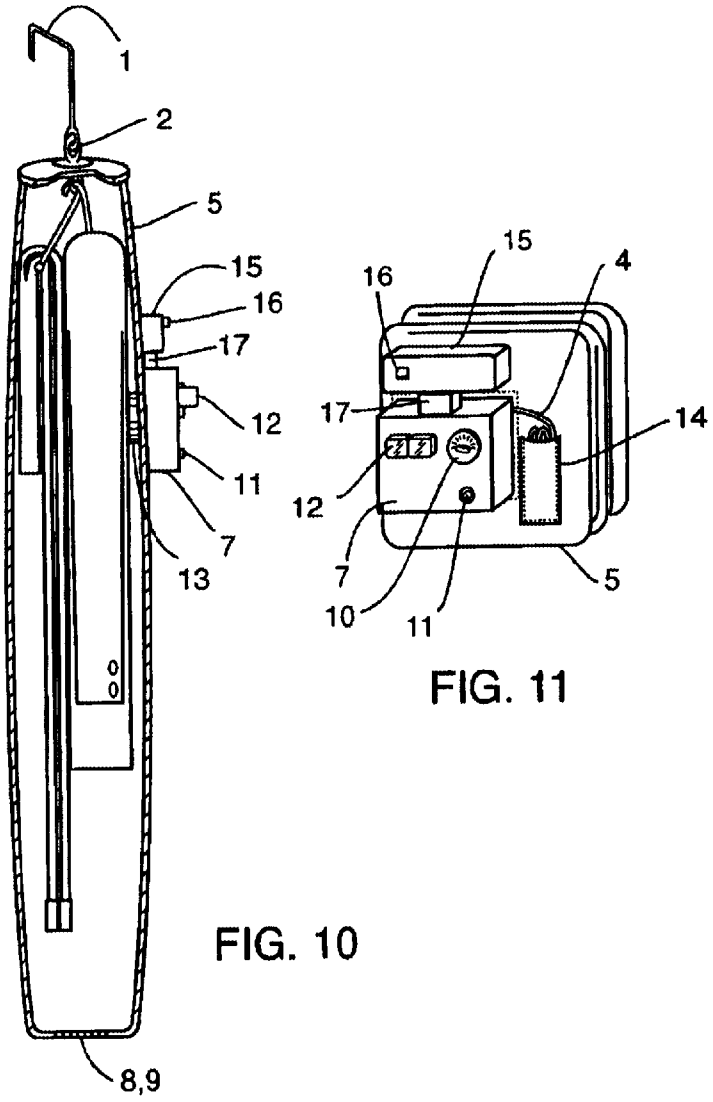
FIG. 8
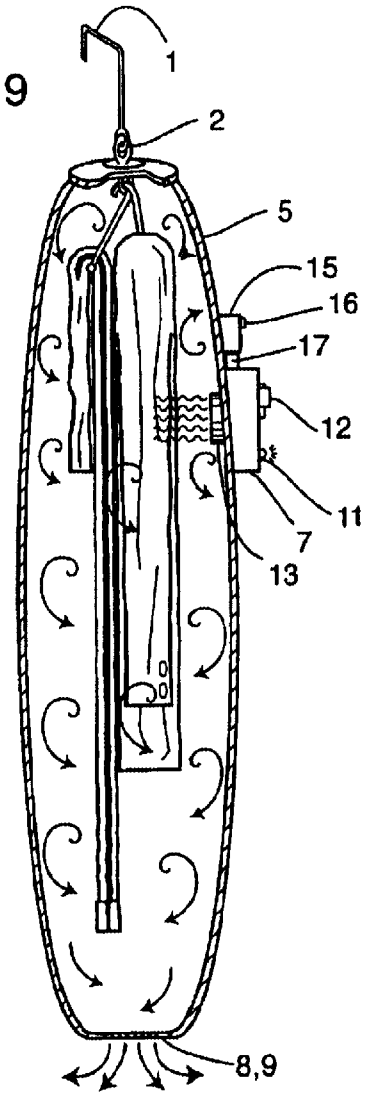
FIG. 9
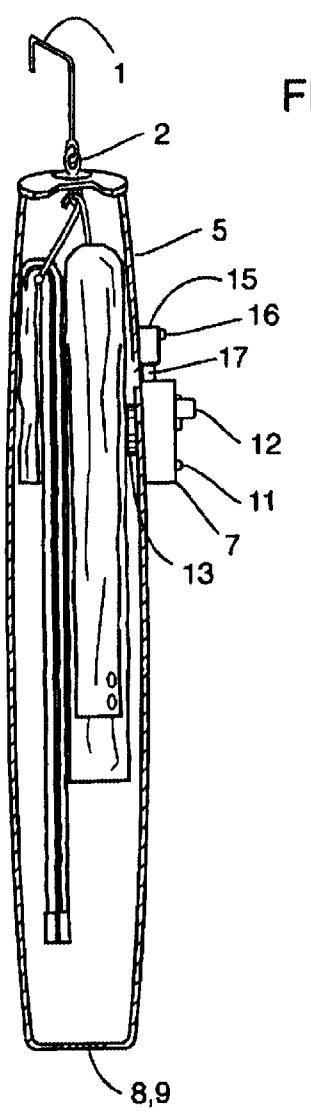
FIG. 10
FIG. 11

APPARATUS FOR HEATING CLOTHES

BACKGROUND—FIELD OF INVENTION

This invention relates to a method and device for cleaning or pressing articles of clothing. The device of the invention incases a heat source, which then evaporates moisture from the clothing using a range of low to high heat depending on the article of clothing being processed and thereby causes a cleaning and pressing of the clothing.

BACKGROUND—DISCRIPTION OF RELATED ART

My invention is not directed at the inconvenience of wrinkled clothing but on the contrary directed at the inconvenience addressing ironing. Originally the prior approach was taking articles of clothing to the cleaners and paying an extensive price. The inconveniences included wasting ones own time, gasoline, and patience of taking an article of clothing to a designated launder when people already have busy lives. Another form of getting the wrinkles out is to do it your-self. To complete this job correctly you would need two items an ironing board and iron. Not only would you need both items but, you would also mentally have to prepare yourself to do something in which is very tedious and time consuming.

We need to face the fact that everyone dreads ironing and most of the time when we iron we do not get the job done correctly not only do we get frustrated and stressed but the articles of clothing still have wrinkles. A solution is definitely needed for the fact that we are all very busy people. My invention is a great means for traveling for the fact that it will be compact and fit in an individual's suitcase. Therefore when the time comes the invention will come in very handy for the fact that he individual will just hang the suit in the bag, and spray fluid on the article of clothing to use the invention. My idea is such a completely unique product, that there is no prior art directly germane to my invention.

OBJECTS AND ADVANTAGES

Accordingly, besides objects and advantages described in my above Patent, several objects and advantages of my invention are:

(a) To provide people the ability to save time and money allowing people to keep their sanity from the scrutinizing pain of ironing.

(b) To provide people an alternative who do not have the ability to spend extensive amounts of money a week on dry-cleaning therefore are obliged to iron themselves or not iron at all resulting in wearing wrinkled clothing.

The object in which my invention accomplishes is an easy way of delegating stressful activity whether it be going to the launder or ironing it your self. Just put the item in the machine and within minutes your clothing is wrinkle free.

Further objects and advantages of my invention will become apparent from a consideration of the drawing and ensuing description.

SUMMARY

My invention constitutes 2 different embodiments of the same invention. The first embodiment is a version of a personal traveling dry cleaning machine. The bag surrounds wrinkled articles of clothing and using a heat source takes the wrinkles out along with a liquid forming steam and moisture to accomplish cleaning. The second embodiment compromises a personal home dry cleaning machine, which surrounds wrinkled articles of clothing, using a heat source is dispersed along with a set amount of steam within the machine and wrinkled items are rendered wrinkle free. Both embodiments are unique for the fact that moisture is introduced into the clothing and a heat source is applied to generate steam.

DRAWING FIGURES

In the drawings, closely related figures have reference numbers but different alphabetic suffixes. FIGS. 1 through 11 show the first embodiement consisting of the traveling dry cleaning machine;

FIG. 8 shows a cross section of FIG. #1 as you can see there is a very wrinkled clothing the holes in the bottom indicate the vents where heat will be dispersed;

FIG. 9 shows cross section of FIG. #1 with light on indicating air flow expanding bag and circulating and escaping through holes on bottom;

FIG. 10 shows cross section of FIG. #1 you can see that after the heat has circulated throughout the garment bag The light turns off and the articles of clothing are left wrinkle free;

FIG. 11 shows view of compacted module;

Figure 14:
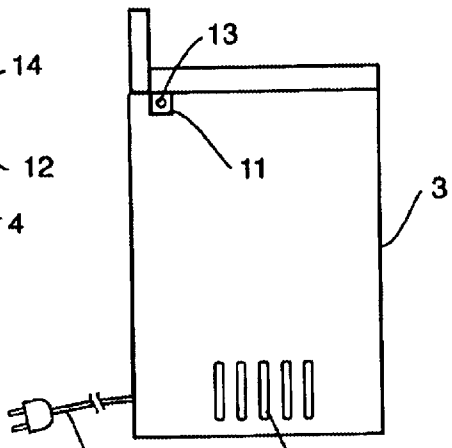
Figure 13:
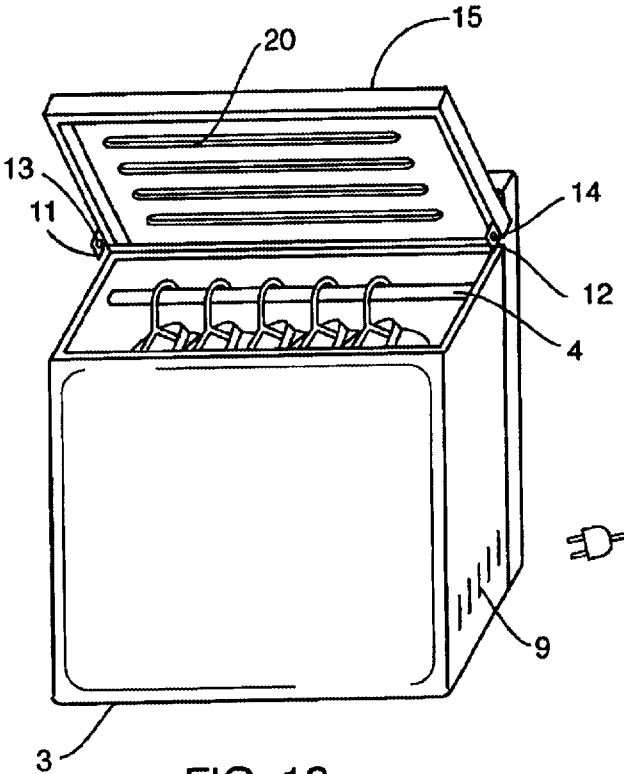
Figure 12:
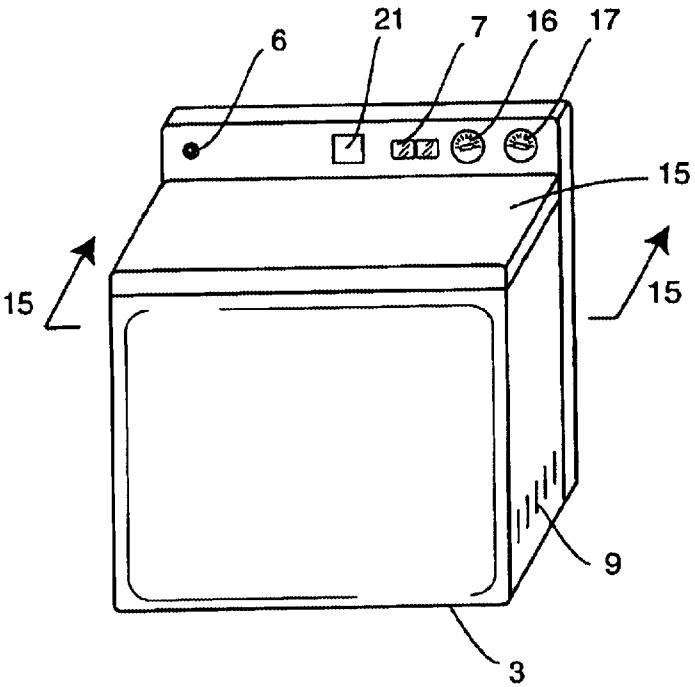
Figure 16:
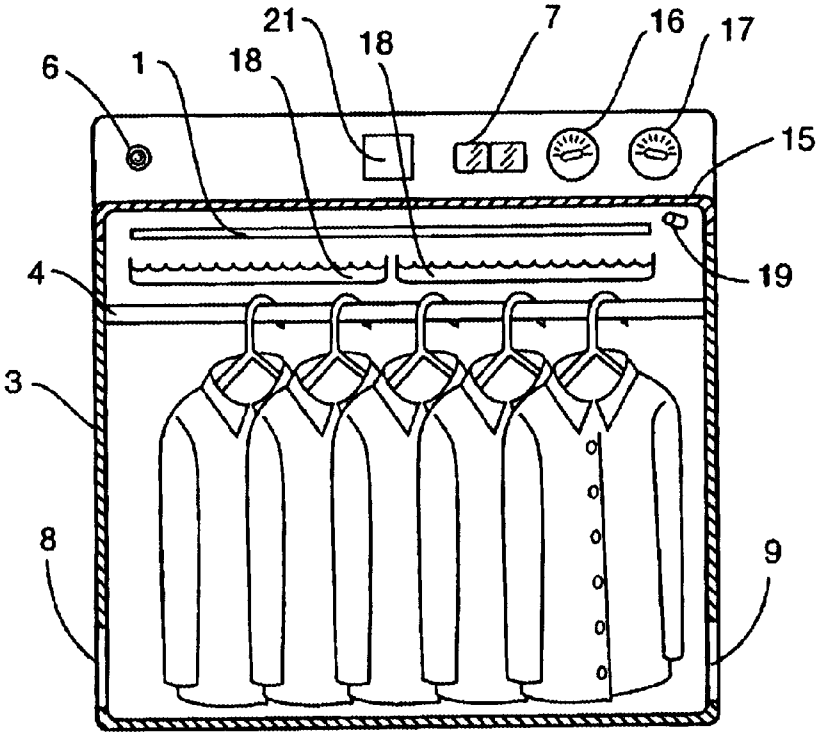
Figure 15:
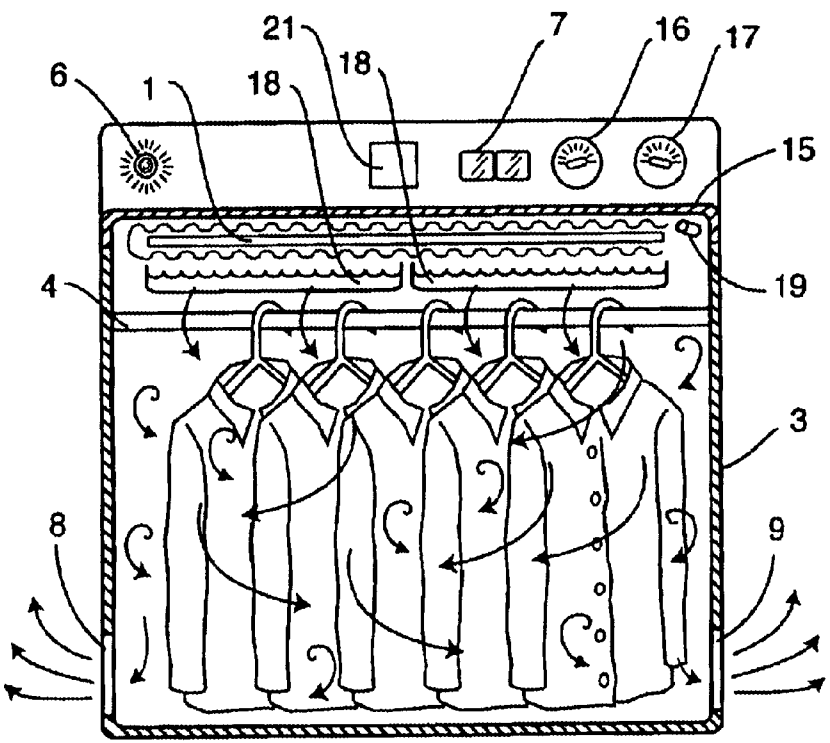

The $2^{nd}$ embodiment constitutes drawings of a personal home dry cleaning apparatus, which can be seen in FIGS. 12 through 16;

FIG. 12 shows a perspective view of the machine from a front and top view;

FIG. 13 shows a perspective top open view showing the items hanging on the inside retaining bar FIG. 13 also shows the heating ducts;

FIG. 14 shows a side elevation view of the machine showing the vents, latches and showing an electrical connection. The cord is truncated, which means it can be as long or as short as we want;

FIG. 15 shows a front elevation view of the machine which is a cutaway showing the wrinkled items and the illuminating red light;

FIG. 16 shows cross section of FIG. 15 including the internal elements. The articles of clothing are wrinkle free clothes and the light is off;

REFERENCE NUMERALS IN DRAWINGS

Embodiment #1

1 hook
2 ring
3 zipper
4 cord
5 bag

6 teeth of zipper
7 control box
8 vent #1
9 vent #2
10 setting button
11 red light
12 on/off button
13 heater/ engine/ fan (using a equipment similar to a manufactured hairdryer)
14 cord pouch
15 rechargeable battery
16 switch/ battery outlet
17 electrical circuit Embodiment #2

1 heater/engine/fan (using equipment similar to a already existing hair dryer)
2 control panel
3 machine/ container
4 retaining bar
5 setting knob
6 red light
7 on/off button
8 vent 1
9 vent 2
10 cord
11 latch #1
12 latch #2
13 screw #1
14 screw #2
15 lid of machine
16 water level
17 steam settings
18 water pan
19 steam regulator
20 air ducts
21 electronic circuit board

DETAILED DESCRIPTION

While we have shown but a few embodiments of the invention, it will be apparent to those skilled in the art that the invention may be embodied still otherwise without departing from the spirit and scope of the claimed invention.

Embodiment #1 (Shows a Version of the Personal Traveling dry Cleaning Machine)

Figures 1, 2, 3:
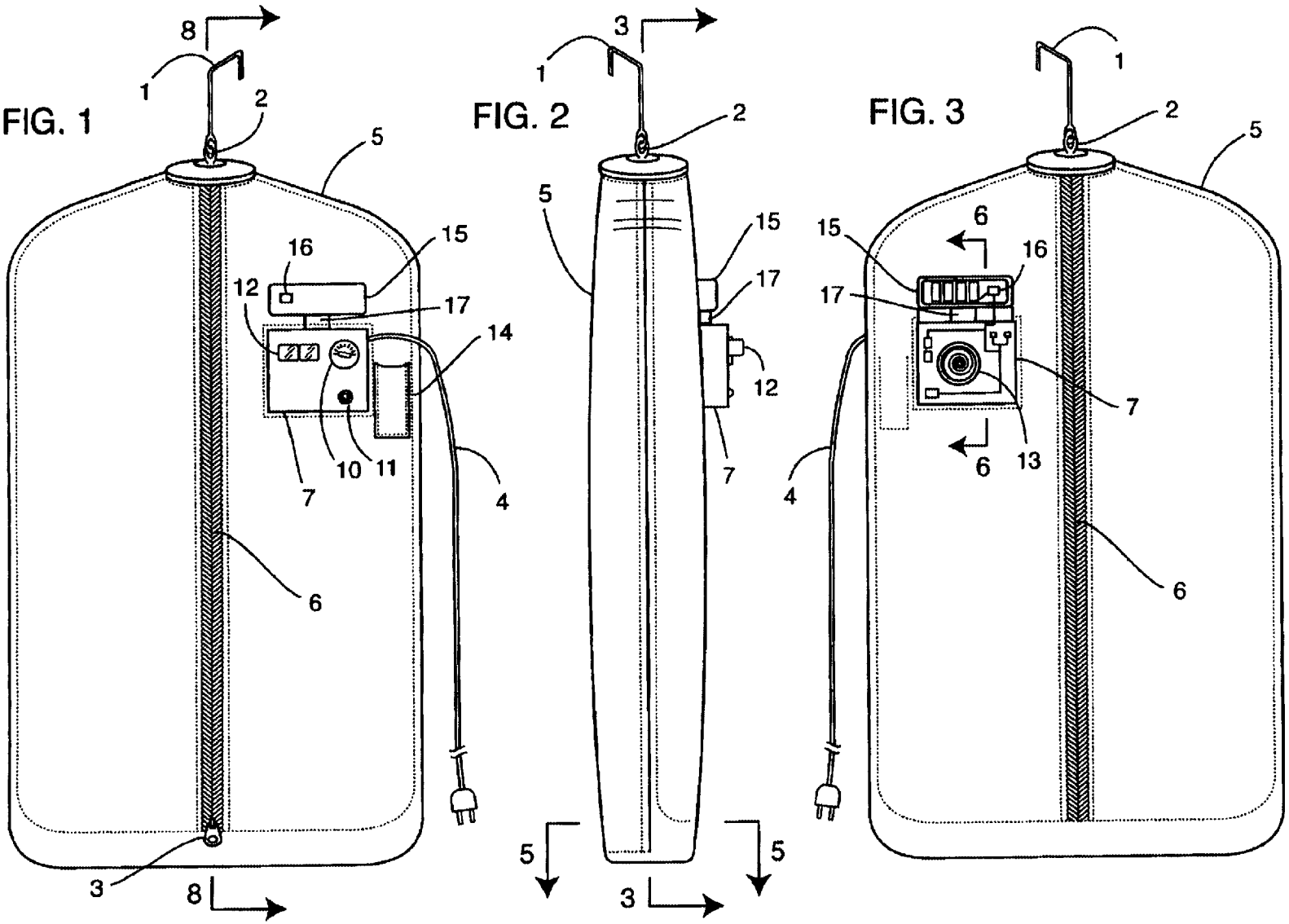
FIG. 1 shows a front elevation view of the bag.
FIG. 2 shows a side elevation view of the bag.
FIG. 3 shows a cross section from FIG. 2.
Figure 5:
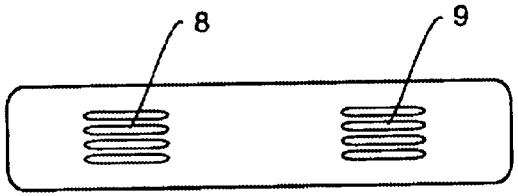
FIG. 5 shows base view of the bag cross-sectioned from FIG. 2.
Figure 6:
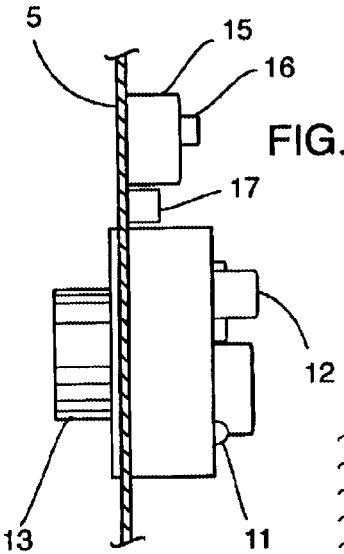
FIG. 6 shows cross section of the heating unit from FIG. 3.
Figure 7:
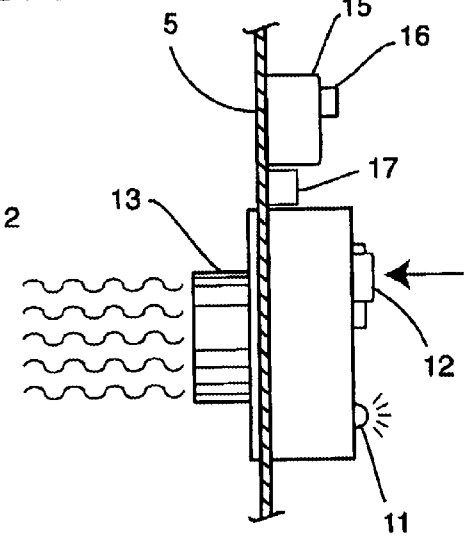
FIG. 7 shows side view of the heater unit with light on and heat being dispersed.
Figure 4:
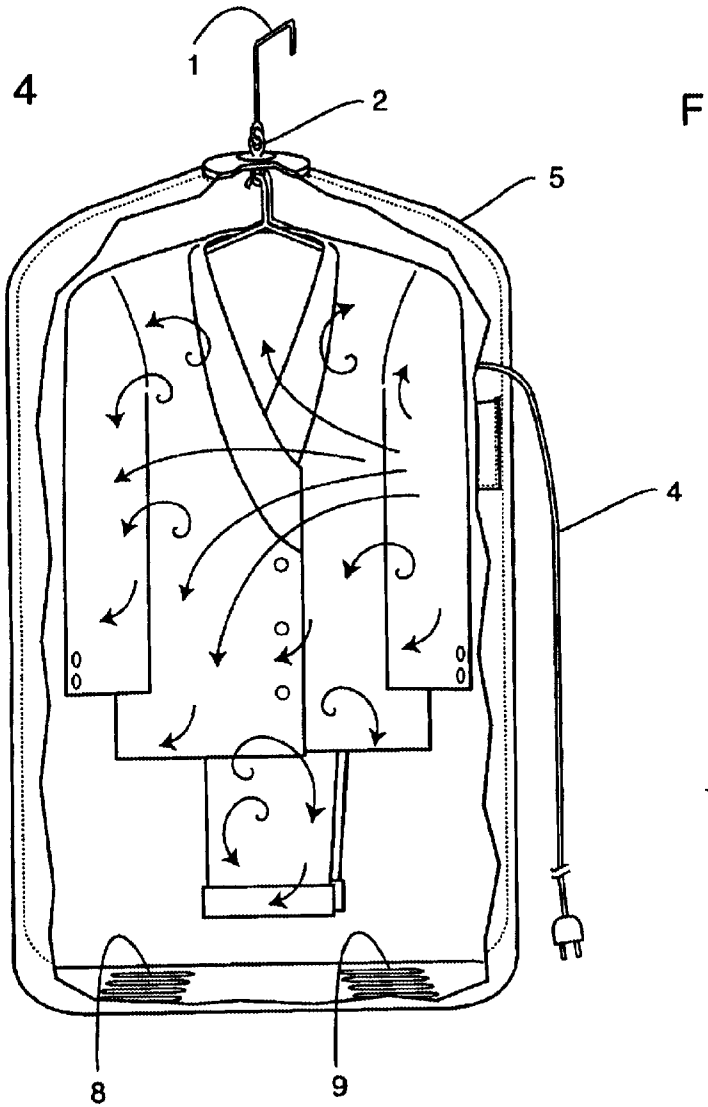
FIG. 4 shows cut away of the bag showing the articles of clothing inside.

Hang the bag 5 to an accessible object (such as in a closet or on a door handle). Then using the zipper 3 unzip the bag 5 by running the zipper 3 along the teeth of the bag 6 in a downward motion. This will allow an open bag 5 in which articles of clothing are placed. Hang articles of clothing inside of the bag 5 on the designated ring 2. Then zip up the zipper 3 using an upward motion against the teeth of the bag 6 forming a seal on the bag 5, which will form a barrier around the articles of clothing and the exterior of the bag. Next choose the desired temperature on the setting button 10 located on the control box 7. When desired setting is acquired a choice will be made to plug in the cord 4 or activate the rechargeable battery 15. The rechargeable battery can be used or bypassed by flipping the switch 16 to battery or outlet located on the control box 7. FIG. 6 shows a picture illustrating the bag 5, heater 13, the rechargeable battery 15, the on/off button 12, and the red light 11. The illustration shows the machine in the off position. Switch the on/off button 12 to on. When machine is on a red light 11 will illuminate acknowledging that the machine is in use. Heat is created and dispersed from the heater 13 and flows throughout the bag 5. FIG. 7 illustrates the heater 13 in the working position with the red light 11 illuminated along with the on/off button 12 pressed to the on position, causing heat to be produced from the heat source 13. The air will circulate throughout the bag and throughout the clothing in the bag as we can see in FIG. 9. The air will be released through the vents 8 and 9 to pressurize the bag 5. When the process is complete the light 11 will turn off and wrinkled free clothing will result as in FIG. 10. The heater 13 will stop before the light goes off for safety purposes indicating a cool down period. FIG. 11 shows a condensed version of the traveling machine. Before entering the articles of clothing into the bag 5 wet the articles of clothing using a spray bottle.

Made out of a durable bag 5 that surrounds the articles of clothing. The bag has a compartment 7 where the heater will reside. Heat will circulate throughout the bag 5 and be released through vents 8 and 9. The cord 4 will hang down from the heater 13 and plug into a wall outlet. When not in use the cord 4 fits into a designated pouch 14 next to the heat source 13. The heater will have temperature settings 10, with settings of low, medium, and high, and a red light 11 indicating when product is finished. The traveling machine has a rechargeable battery 15, which enables the consumer, the ability to not have to use a cord 4. A novelty to the invention is the timer, which controls a dwell period after the heating allowing a cool down period. The timer is located on the electrical circuit board 17.

Embodiment #2 (A Version of the Personal Home dry Cleaning Machine)

As we can see in FIGS. 12 through 16. The machine 3 enables us to perform an apparatus for heating clothes. Place the machine in desired location and plug the cord 10 into a power outlet. Then place the clothes into 3 by lifting the lid 15 and hang the articles of clothing on the retaining bar 4. Next, close the lid of the machine 15. It may be desired to incorporate latches 11,12 to secure the machine. Once we have closed the machine we will choose the proper settings 5. We will choose heat settings between high, medium, and low depending on material. Once we have choosen the proper setting we will have the option to choose a separate setting for steam 17. The steam can be dispersed at a chosen level using the steam regulator 19. The water level 7 will indicate the amount of water in the machine. The heat produced from the heat source will flow out of the air ducts 20 over the water pan 18 creating steam. The steam regulator 19 will allow different steam variances to be produced and released into the machine from a level of 1 being the lowest to a level of 5 being the highest. Once decision making is complete the on/off button 7 should be turned on. When pressing 7 a red light will appear 6. Once this light 6 goes on the process is underway. The heat source 1 produces set amplitude of heat and forms a heat wave, which is dispersed through the air ducts 20. This heat wave travels throughout the upper portion of the machine over a water pan 18. Steam is then formed and released into the machine 1. The heat waves released from the air ducts 20 circulate over the water pan 18 then are filtered through the steam regulator 19. Upon exiting the steam regulator 19 steam is exerted across every inch of clothing as we can see in FIG. 15. Heat then will be released out the vents 8,9 therefore idealizing the pressure. After the process is completed we can see that in FIG. 16 the items are rendered wrinkle free. The heater 1 will turn off and upon a cool-down period items may be extracted from the machine 3. A novelty to the machine is a timer, which will control a dwell period after the heating allowing a cool down period which is located on the electronic circuit board 21.

The machine 3 is made out of lightweight sturdy material. Enabling my product to be compact and fit in designated spaces. The lid of the machine 15 will flip open enabling the articles of clothing to be placed on the retaining bar 4 which will connect to both sides of the interior of the machine 5 and will be sturdy enough to hold several articles of clothing. It may be desired to incorporate latches 11,12 to close the lid which will be air tight using rubber moldings (such that of a dryer.) A knob for heat settings 5 will disperse set amplitudes of heat depending on fabric and material. There is a setting for steaming 17, which produces a set amount of steam depending on articles of clothing. The air produced from the heat source 1 is carried over the water pan 18, which in turn forms steam. The amount of steam will be regulated using the steam regulator 19. An electric cord 10 will be connected to the Home machine. The heat will be generated and circulated around the articles of clothing then released out the vents 8,9. A water gauge 16 is next to the setting knob 5 to indicate the amount of water in the machine for the steaming process, when the line on the water gauge, hits the low level it is time to add more water. The articles of clothing will be upright and upon a timely heat disbursement rendered wrinkle free. The cycle may complete before the light 6 goes off allowing a cool-down period to occur. Consumers should wait until light 6 is off to open machine.

Thus the reader can see that the machine provides a highly reliable, lightweight, yet economical device that can be used by persons of almost any age. While my above description contains many specifications, these should not be construed as limitations on the scope of the invention, but rather as an exemplification of two preferred embodiment thereof. Many other variations are possible. For example:

The size of the machine can be:

Changed in size (made smaller or larger)

Made of a different material

Made of a different shape

Made of a different color

The heater or heaters on the machine can be:

Located on the top/bottom/ back portion of the machine

May vary in size

May vary in temperature

The control panel/settings/steam/ can be:

Placed wherever is convenient to the controller

The electronic circuit board can be:

Placed wherever is convenient to the controller

The cord can be:

Located wherever is convenient to the controller

Have its own storage compartment when not in use.

The rechargeable battery can be:

Located wherever is convenient to the controller

The vents can be:

Located on the back/side/top/ or front of the machine.

What is claimed is:

1. A personal dry cleaning apparatus which allows for home or private dry cleaning use, said apparatus comprising:

a) an outer housing;

b) means forming an enclosing compartment in said housing for receiving one or more articles of clothing to be dry cleaned and which can be suspended in said compartment;

c) an openable portion on said housing allowing access to said compartment;

d) an elongate rod means in said compartment for suspending said one or more clothing articles so that they are generally vertically arranged;

e) wetting means associated with said housing for introducing a limited amount of a dry cleaning liquid into the one or more clothing articles such that they contain the moisture in their suspended position;

f) heating means for generating heat in said compartment in sufficient amount to cause a steaming of the dry cleaning liquid; and g) said heating means being located to cause heated air to pass through portions of the articles to evaporate or causing steaming of the liquid in the clothing articles to thereby effect a personalized cleaning of one or more clothing articles; and h) vent means to allow for a venting of heated air in the compartment along with any moisture entrained therein, and where the heated air is directed from one of an upper portion of the compartment to a lower portion or from a lower portion of the compartment to an upper portion and where the vent means is located at one of said portions opposite the heating means for allowing of venting of the air and any entrained moisture.

2. The personal dry cleaning apparatus of claim 1 further characterized in that the means forming an enclosing compartment comprises a rigid housing with an openable door providing access to said compartment.

3. The personal dry cleaning apparatus of claim 1 further characterized in that the means forming an enclosing compartment comprises a flexible material bag also capable of being suspended and which has an openable and closable portion allowing access to said compartment.

4. The personal dry cleaning apparatus of claim 3 further characterized in that said openable and closable portion comprises an elongate opening allowing clothing articles to be inserted into and removed from said compartment and which elongate opening has mating opened edges capable of being brought together and closed for substantially the full dimensions of said elongate opening.

5. The improvement in the dry cleaning apparatus of claim 4 further characterized in that a wetting means is provided with said apparatus for introducing a limited amount of liquid moisture into said one or more clothing articles so that the articles contain a limited amount of moisture therein which can be generated into a steam for cleaning the articles.

6. The improvement in the dry cleaning apparatus of claim 5 further characterized in that the wetting means is a bottle of a dry cleaning liquid with a dispenser allowing a limited amount of the liquid to be applied to the clothing articles.

7. The improvement in the dry cleaning apparatus of claim 5 further characterized in that the wetting means is a source of a dry cleaning liquid in said compartment and said heating means is disposed in close relationship to said source of liquid to heat the liquid therein and thereby allow a limited amount of the liquid to be applied to the one or more clothing articles.

8. The improvement in the personal dry cleaning apparatus of claim 5 further characterized in that the means forming an enclosing compartment comprises a flexible material bag also capable of being suspended and which has an openable and closable portion allowing access to said compartment, and said openable and closable portion comprises an elongate opening allowing clothing articles to be inserted into and removed from said compartment and which elongate opening has mating opened edges capable of being brought together and closed for substantially the full dimensions of said elongate opening.

9. The improvement in the personal dry cleaning apparatus of claim 8 further characterized in that said compartment is arranged so that it has a substantial vertical dimension allowing the clothing articles to be suspended and where the heated air is directed from one of an upper portion of the compartment to a lower portion or from a lower portion of the compartment to an upper portion and where the vent means is located at one of said portions opposite the heating means for allowing of venting of the air and any entrained moisture.

10. The personal dry cleaning apparatus of claim 5 further characterized in that the compartment comprises an elongate rod to enable suspending of the one or more clothing articles by hanging said one or more clothing articles.

11. The personal dry cleaning apparatus of claim 5 further characterized in that steam release means is provided on the means forming the enclosing compartment and allows for a release of steam from the compartment.

* * * * *